US007995322B2

(12) United States Patent
Shaw

(10) Patent No.: US 7,995,322 B2
(45) Date of Patent: Aug. 9, 2011

(54) PORTABLE AIR IONIZER, INTERFACE FOR A PORTABLE IONIZER, AND METHOD OF ADVERTISING THEREWITH

(75) Inventor: Joshua Shaw, Queensland (AU)

(73) Assignee: Bionic Products Pty Ltd., Queensland (AU)

( * ) Notice: Subject to any disclaimer, the term of this patent is extended or adjusted under 35 U.S.C. 154(b) by 460 days.

(21) Appl. No.: 12/193,404

(22) Filed: Aug. 18, 2008

(65) Prior Publication Data

US 2010/0039746 A1 Feb. 18, 2010

(51) Int. Cl.
*H01T 23/00* (2006.01)
*H05F 3/00* (2006.01)

(52) U.S. Cl. ..... 361/231

(58) Field of Classification Search ..... 361/231
See application file for complete search history.

(56) References Cited

U.S. PATENT DOCUMENTS

| | | | | |
|---|---|---|---|---|
| 1,266,175 | A | 5/1918 | Tesla | |
| 3,818,269 | A | 6/1974 | Stark | |
| 4,713,724 | A | 12/1987 | Voelkel | |
| 4,941,068 | A | 7/1990 | Hofmann | |
| 5,484,472 | A | 1/1996 | Weinberg | |
| 5,973,905 | A | 10/1999 | Shaw | |
| 6,042,637 | A | 3/2000 | Weinberg | |
| 2002/0076512 | A1* | 6/2002 | Kreider | 428/34.1 |
| 2003/0147784 | A1 | 8/2003 | Joannou | |
| 2005/0147544 | A1 | 7/2005 | Joannou | |
| 2005/0147545 | A1 | 7/2005 | Lau et al. | |
| 2008/0250190 | A1* | 10/2008 | Johnson | 711/103 |

FOREIGN PATENT DOCUMENTS

| | | |
|---|---|---|
| JP | 2004-47308 | 2/2004 |
| JP | 2004-89531 | 3/2004 |
| JP | 2005-38731 | 2/2005 |
| JP | 2006-179363 | 7/2006 |
| WO | WO 95/08368 | 3/1995 |

OTHER PUBLICATIONS

United Kingdom Intellectual Property Office, Examination Report issued in corresponding United Kingdom Patent Application No. GB0913809.0, Sep. 17, 2010.

United Kingdom Intellectual Property Office, Search and Examination Report, U.K. Patent Application No. 0913809.0, Dec. 8, 2009.

* cited by examiner

*Primary Examiner* — Ronald W Leja
(74) *Attorney, Agent, or Firm* — Vedder Price P.C.

(57) ABSTRACT

This disclosure relates to a portable ionizer worn in the vicinity of the human face, including, for example, a necklace to diffuse concentrations of negative ions in the facial area of the wearer where the ions are beneficial. As a consequence of this capacity to focus the ion flux, fewer ions must be produced by the source to obtain the benefit to the wearer because of a greater local concentration. The necklace ionizer is given a pleasing external appearance and a useful purpose, such as an advertising display. The negative ions are generated by a high-voltage alternate frequency ion generating needle. A control module including a power management system, a transformer, and a multiplier is used to minimize power drain on a rechargeable battery. Other features of the power management system include an LED display shut-off, battery voltage cut-off, management of needle life, and management of power supply drain time through frequency modulation or voltage control.

20 Claims, 8 Drawing Sheets

PORTABLE AIR IONIZER, INTERFACE FOR A PORTABLE IONIZER, AND METHOD OF ADVERTISING THEREWITH

FIELD OF THE DISCLOSURE

This disclosure relates to a portable ionizer, and more specifically, to a portable necklace ionizer worn below the human face with an interface for placement of advertising and the method of advertising therewith.

BACKGROUND

Darwinian theory states that humans evolved on Earth and are consequently adapted to interact beneficially with their environment. For example, when exposed to sunlight, human skin synthesizes vitamin D, a useful vitamin for overall well-being. The use of blue light (i.e., the color of the sky), when used in conjunction with an aminolevulinic acid treatment, is documented to improve porphyrin response times in skin.

The human eye is another organ known to react to environmental factors. Phototherapy, or the science of exposing the body to a spectrum of light for therapeutic purposes, is known or believed to be effective in treating Seasonal Affective Disorder, nonseasonal depressions, and delayed sleep phase syndrome when specific types of light are received by the human eye. Applicant's technology relates to known benefits associated with short-term exposition of the human breathing apparatus to mildly ionized air.

The Earth's environment includes an atmosphere made mostly of oxygen gas ($O_2$), nitrogen gas ($N_2$), water vapor ($H_2O$), some carbon dioxide gas ($CO_2$), and traces of rare gases such as hydrogen gas ($H_2$). These gaseous molecules are found in greater proportions in their neutral electrical valence than in positively or negatively charge valences. In the environment, because of a plurality of natural causes, including, for example, lightning, static electricity, cosmic irradiation, chemical processes, and even molecular interactions, the valence of these molecules can change from positive to negative or vice versa. A negative ion is a neutral molecule holding an extra electron defined by convention as a negative charge ($O_2^-$, $N_2^-$, $H_2O^-$, $CO_2^-$, $H_2^-$, or $O_3^-$). A positive ion is a neutral molecule with one missing electron resulting in a positive charge of the molecule. In air, some of these ions are found as molecules surrounded by neutral valence water vapor. Numerous control studies have shown that human wellbeing is enhanced in artificially environments having negative ionization. Other studies have shown that high-voltage or high-frequency ionization of air can result in the creation of undesired chemical reactions in air, including, for example, the formation of $O_3$, $NO_2$, $NO_3$, $H_2O(O_3)$, etc.

Joshua Shaw is the owner of U.S. Pat. No. 5,973,905, which is incorporated fully herein by reference and is directed to a tabletop negative air ion generator with selectable frequencies. This invention is directed to a multineedle generator capable of voltage and frequency modulation to create a controlled electronic corona to break down the dielectric potential of some molecules in air. The principle technology is the creation of a strong localized magnetic field capable of exciting molecules at natural resonating frequencies in the vicinity of a sharp tipped needle where the curvature is maximized to bend the magnetic field to greater potentials.

However, negative and positive ions are naturally unstable and revert to their neutral state once they encounter their counterpart, or in the case of a positive ion, once it finds a loose electron. For the beneficial effect of the current invention to be observed, a noticeable quantity of ions must be produced and placed in the atmosphere. The inventor's previous device is equipped with a plurality of ion-producing needles, each capable of generating a flux sufficient to produce an ionized environment within a room. The device is large, requiring prominent placement in a room, and many ions are lost to transfer within the room, thereby limiting the beneficial effect. Further, the energy needed to operate the prior art device with a plurality of needles is greater than the energy needed to operate a device with a single needle.

What is needed is an ion-producing device where a greater quantity of the ions produced are used beneficially, waste is reduced, and energy is conserved. What is also needed is an ion generator capable of integration within the environment.

SUMMARY

This disclosure relates to a portable ionizer that can be worn in the vicinity of the human face, including, for example, a necklace to diffuse concentrations of negative ions to the facial area of the wearer where the ions are beneficial. As a consequence of this capacity to focus the ion flux, fewer ions must be produced by the source to obtain the desired benefit to the wearer than in prior art devices. The necklace ionizer is given a pleasing external appearance and a useful purpose, such as advertising on its surface.

The negative ions are generated by a high-voltage alternate frequency ion-generating needle. A control module, which includes a power management system, a transformer, and a multiplier, is used to minimize power drain on a rechargeable battery. Other features of the power management system include an LED display shut-off, battery voltage cut-off, management of needle life, and management of power supply drain time through frequency modulation or voltage control.

BRIEF DESCRIPTION OF THE DRAWINGS

Certain embodiments are shown in the drawings. However, it is understood that the present disclosure is not limited to the arrangements and instrumentality shown in the attached drawings.

DETAILED DESCRIPTION

Figure 1:
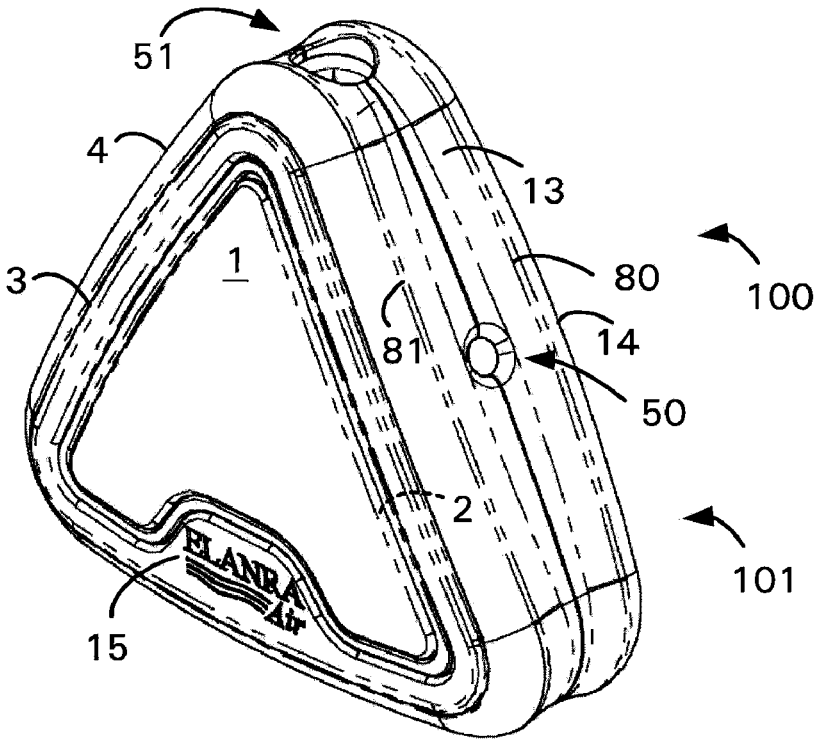
FIG. 1 is a front isometric view of the pendant ionizer without neck strap according to a first embodiment of the present disclosure with at least a first advertising space according to an embodiment of the present disclosure.

For the purposes of promoting and understanding the principles disclosed herein, reference is now made to the preferred embodiments illustrated in the drawings, and specific language is used to describe the same. It is nevertheless understood that no limitation of the scope of the invention is hereby intended. Such alterations and further modifications in the illustrated devices and such further applications of the principles disclosed and illustrated herein are contemplated as would normally occur to one skilled in the art to which this disclosure relates.

Figure 2:
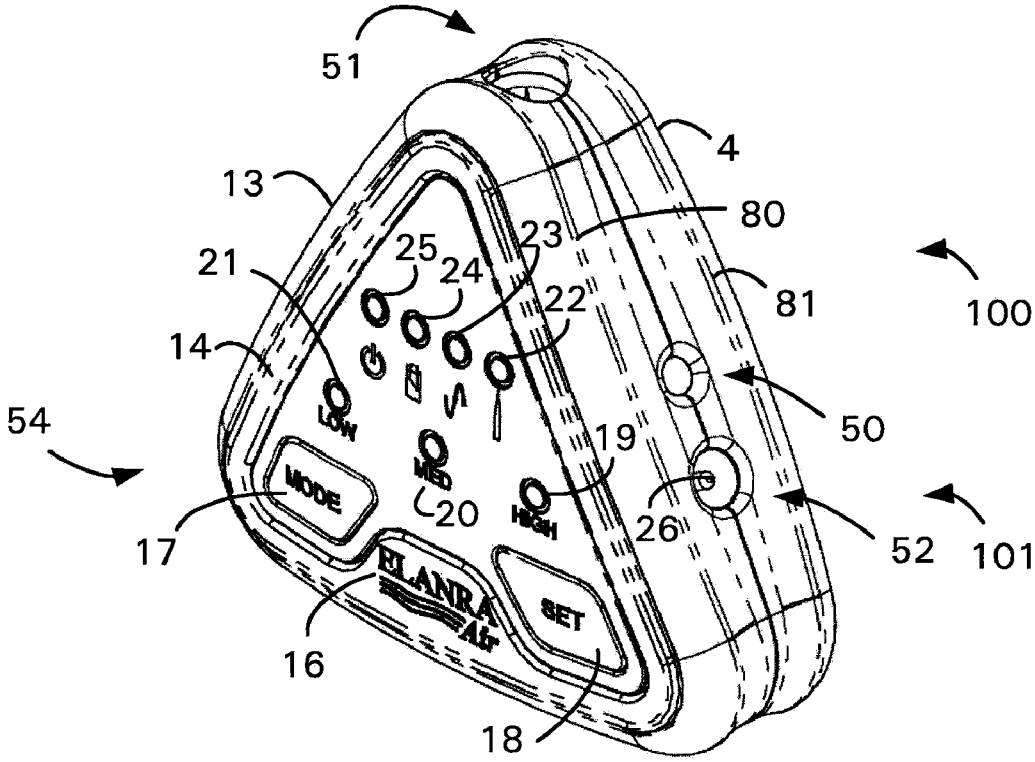
FIG. 2 is a back isometric view of the pendant ionizer of FIG. 1 with a control panel according to an embodiment of the present disclosure.
Figure 3:
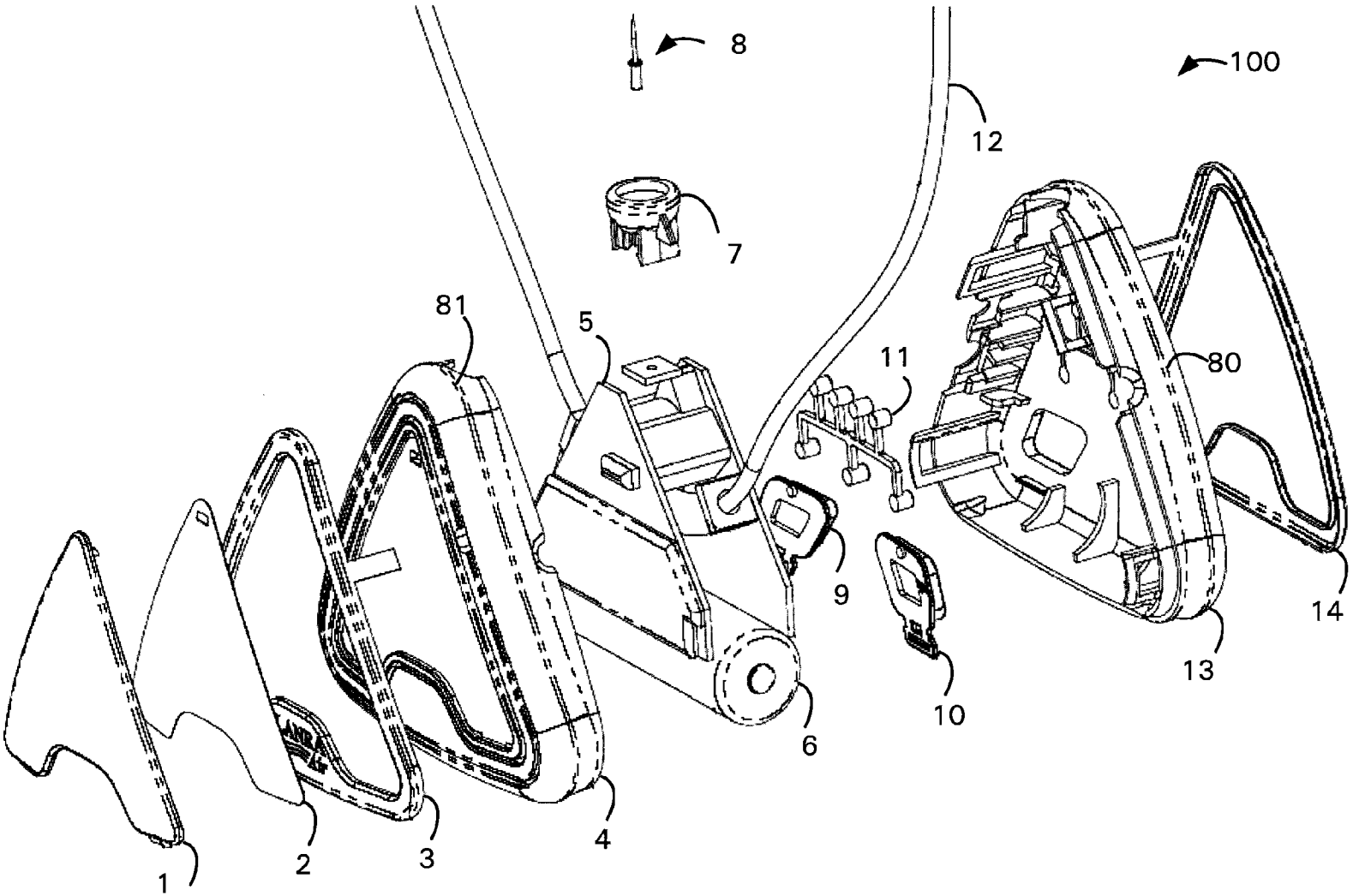
FIG. 3 is an exploded front isometric view of the pendant ionizer of FIG. 1 with neck strap according to an embodiment of the present disclosure.
Figure 4:
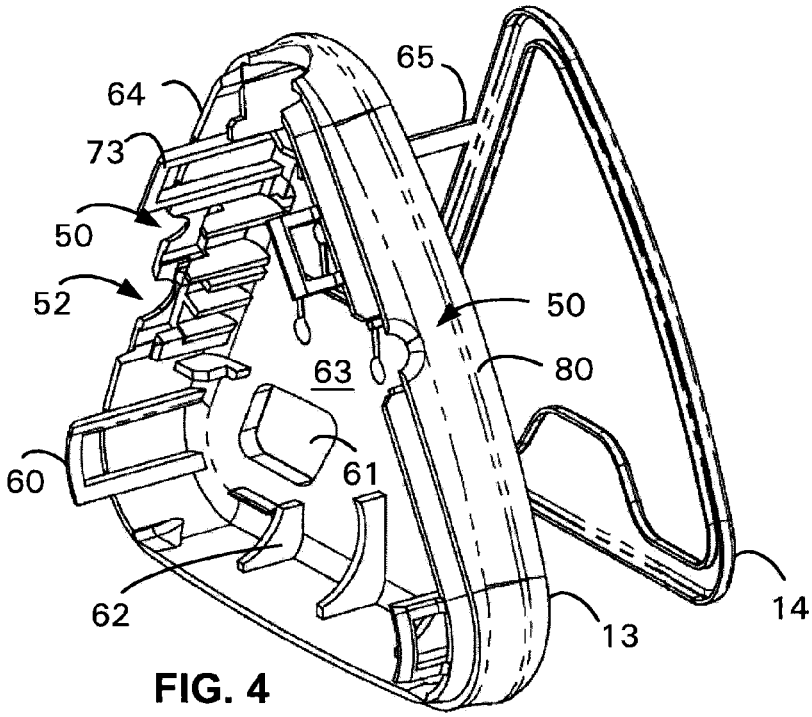
FIG. 4 is an exploded isometric view of the back portion of the portable case and a first protection surround as shown in FIG. 3 according to an embodiment of the present disclosure.
Figure 5:
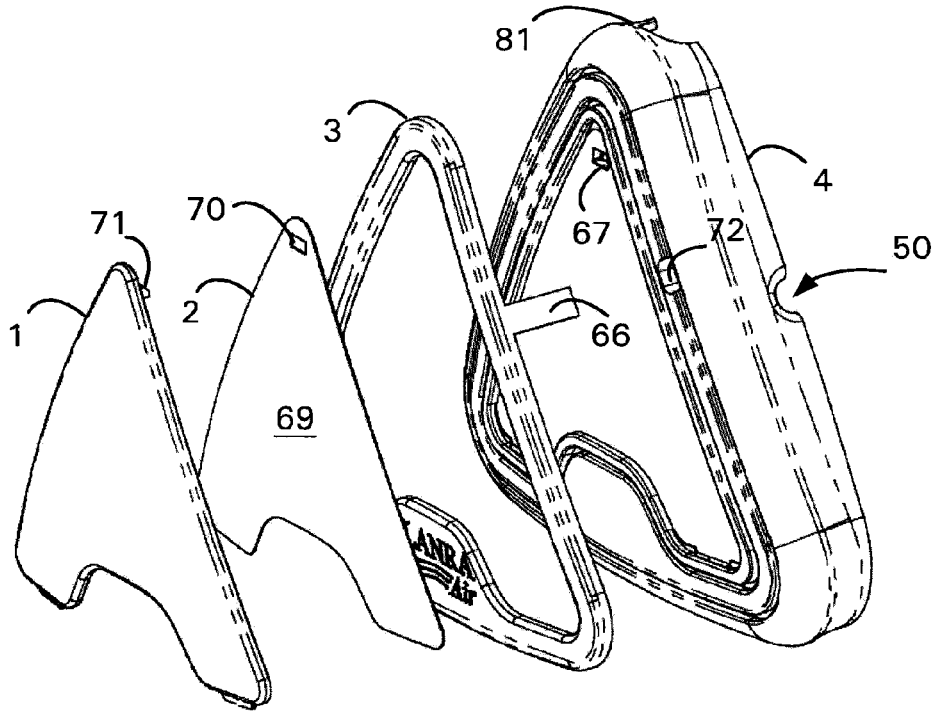
FIG. 5 is an exploded isometric view of the front portion of the portable case and a second protection surround of the pendant ionizer as shown in FIG. 3 according to an embodiment of the present disclosure.
Figure 6A:
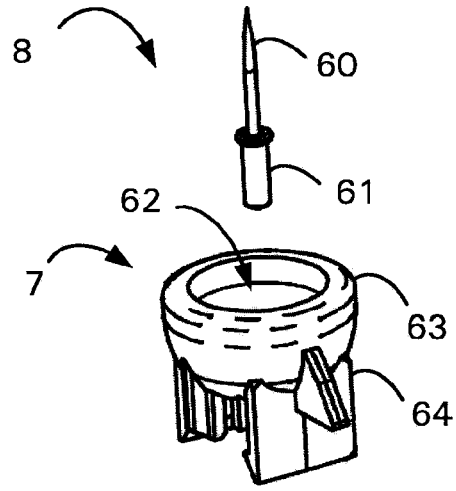
FIG. 6A is a close-up view of the needle and the needle protector as shown in FIGS. 3 and 6 with greater detail according to an embodiment of the present disclosure.
Figure 6:
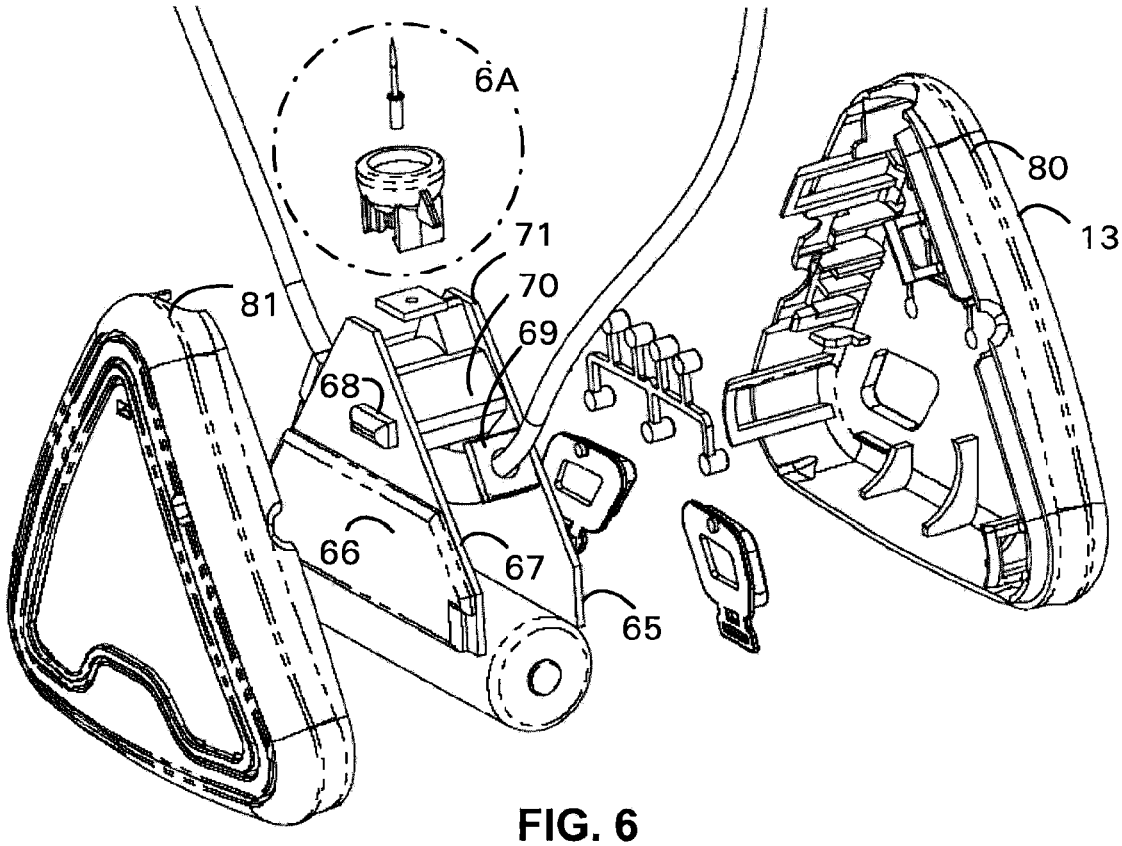
FIG. 6 is an exploded isometric view of the front and back portions of the portable case of the pendant ionizer with internal components as shown in FIG. 3 according to an embodiment of the present disclosure.

FIG. 1 shows the pendant ionizer 100 without neck strap in a front isometric view, FIG. 2 shows the pendant ionizer 100 from the back, and FIG. 3 shows an exploded view of the pendant ionizer 100 of FIG. 1 with neck strap 12. The ionizer 100 includes a portable case 101 shown in a triangular shape with curved corners and rounded bevels. The case 101 as shown in greater details in FIGS. 3-6 is made of a front portion 4 and back portion 13 as snap-shut plastic molded shells as illustrated by 80, 81 with a plurality of internal structural elements such as a lip 64 on the back portion 13 for connection with the front portion 4 and a series of tabs 73, 60 for support of tabs from other supporting elements 65 located on the first protection surround 14 made of metal and acting as a ground connected via wire to the negative pole of the power source 6 or the second protection surround 3 also connected via the supporting elements 66 to the battery 6. The front and back portions 4, 13 also show at their interface circular openings 50, 51, 52 for the passage of the neck strap 12 in opening 50, access to a charger (not shown) in opening 52, and an opening or passage 51 for the release of negative ions from the needle 8. Other features such as support ribs 62 for holding the power source 6 are attached to the internal portion 63 of the back portion 13. The internal portion 63 also includes openings 61 for the passage of buttons 9, 10 or LEDs 11 as shown in FIG. 3. The internal portions also support of the integrated circuit 5, and the needle support 7 along with the needle 8. FIG. 5 shows how the protection surrounds 3, 14 can be slid into small openings 72 made in the case covers 4, 13 to lock in place via support tabs 73, 60 electrically connected to the breadboard or the negative pole of the battery 6.

A triangular portable case 101 is shown and contemplated as the most compact embodiment where the battery 6 is cylindrical and is located at the bottom portion of the case 101 and the needle holder is located at the top portion of the case 101. While one geometry of the portable case 101 is shown, the use of any case shape holding a power source of any geometry capable of association with one or a plurality of negative ion needles 8 is contemplated. For example, if two needles are used in an alternate embodiment working with two cylindrical batteries, a square case can be used to optimize the volume of the overall pendant ionizer 100. One of ordinary skill in the art recognizes the different combinations of geometries used in conjunction with different geometries of DC battery power sources. One of ordinary skill in the art also recognizes that while a neck strap 12 is shown, other means to secure the pendant ionizer 100 are contemplated, including but not limited to an elastic arm band, a clip, a brace, a pin, a magnet, or any other type of fixation means commonly employed to attach a device to a wearer.

Returning to FIG. 1 and the greater detail shown in FIG. 5, a transparent window 1 is placed on a paper decal 2 snapped in place on the front case cover 4 using at least one snap clip made of a female portion 67 on the case cover 4 and a male portion 71 on the transparent window 1 passing as shown through an opening 70 made on the paper decal 2 to ultimately secure the paper decal to the pendant ionizer 100 creating a first advertising space 69 on the external surface of the portable case 4. Once again, what is shown is a triangular paper decal 2 and attachment structure associated with the overall triangular shape of the pendant ionizer 100. One of ordinary skill in the art recognizes that while one shape is contemplated, advertising can be optimized by creative and aesthetic changes to suit advertisements on the device. This disclosure contemplates the use of an advertising space 69 either shielded by the transparent window 1 or without such a window 1. For example, paper decal 2 can have an adhesive side, can be permanently fixed to the case cover 4, or can be made part of the case cover 4 either with or without relief or color. What is also contemplated is the use of the pendant ionizer 100 integrated with other devices, including, for example, a pair of glasses, earphones, an existing necklace, or an item placed within a pocket or holder on a vest. In another embodiment, the case 101 includes a second advertising space on the external surface in opposition of the first advertising space, such as, for example, ELANRA AIR™ shown as 16 in FIG. 2. In yet another embodiment, a third advertising space on the external surface can be located next to the first advertising space shown as 15 in FIG. 1. While several advertising spaces are shown, what is contemplated is the use of a plurality of advertising spaces in any orientation or position used in association with the pendant ionizer 100.

Figure 7:
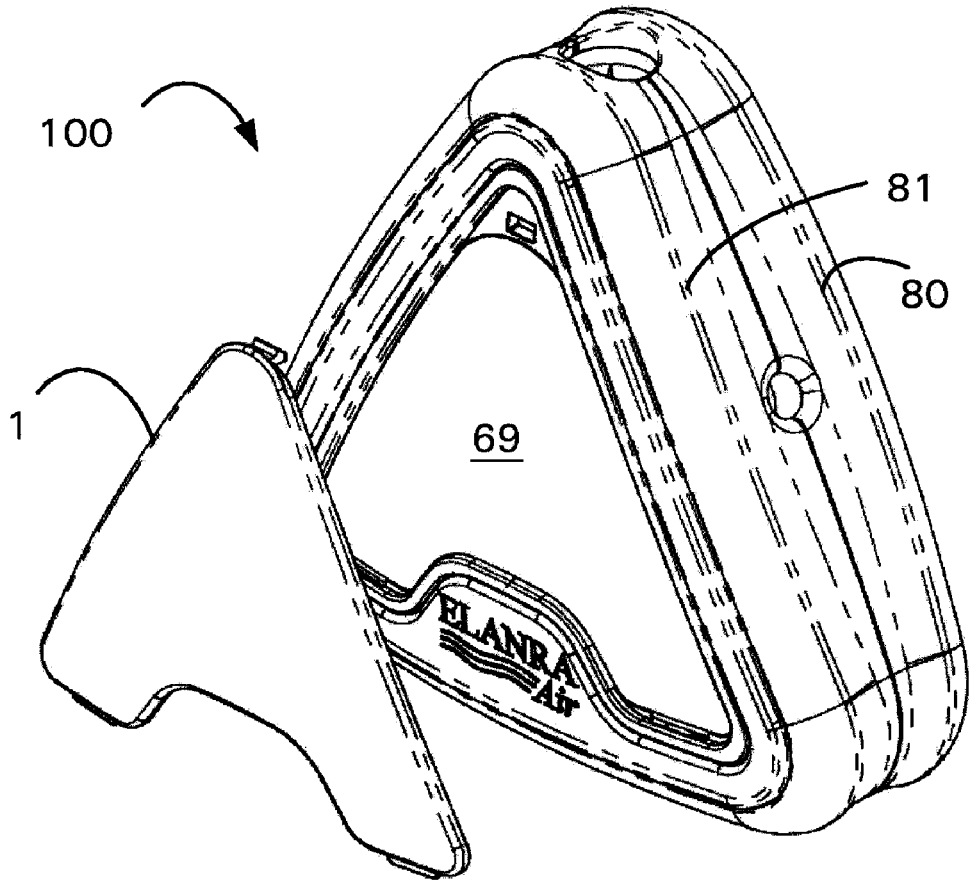
FIG. 7 is a partly exploded isometric view of the portable case of FIG. 1 with a cover removed according to another embodiment of the present disclosure.
Figure 7A:
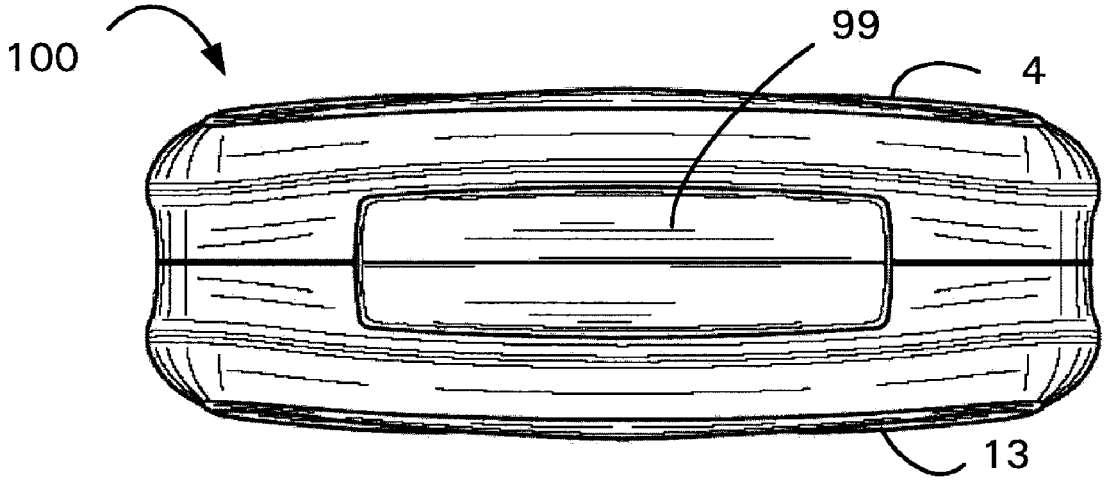
FIG. 7A is a bottom view of the portable case of FIG. 1.
Figure 8:
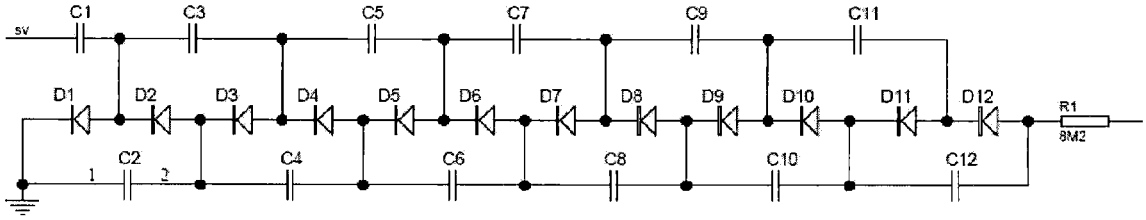
FIG. 8 is a diagrammatic representation of the high-voltage power supply circuit according to one embodiment of the present disclosure.
Figure 9:
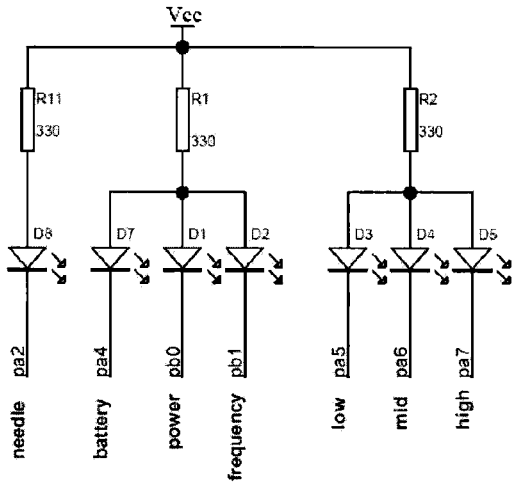
FIG. 9 is a diagrammatic representation of LED distribution according to one embodiment of the present disclosure.
Figure 10:
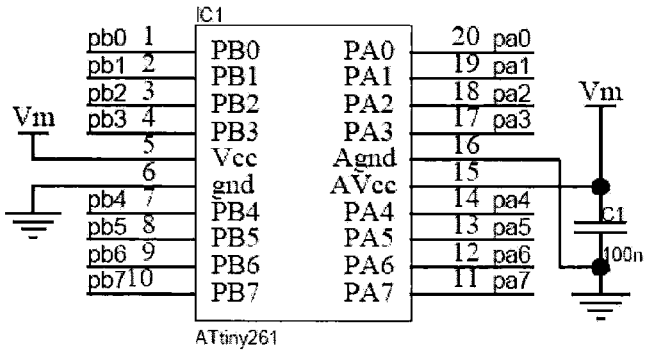
FIG. 10 is a diagrammatic representation of the microprocessor of the pendant ionizer according to one embodiment of the present disclosure.
Figure 11:
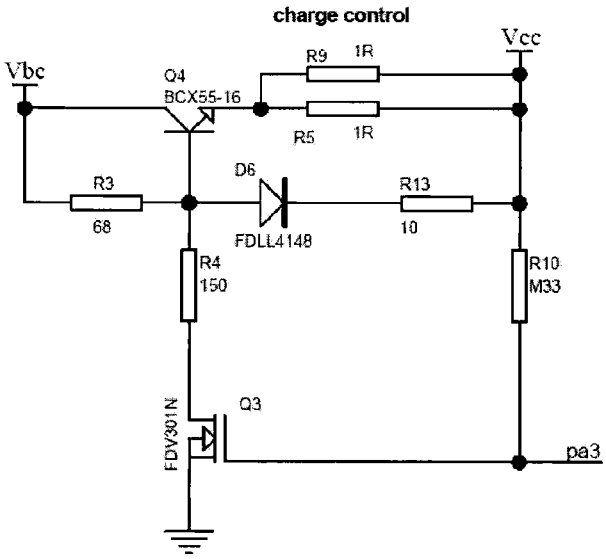
FIG. 11 is a diagrammatic representation of the charge control of the pendant ionizer according to one embodiment of the present disclosure.
Figure 12:
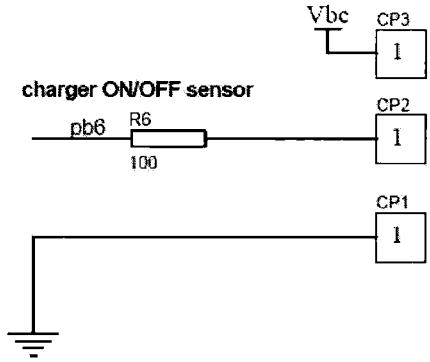
FIG. 12 is a diagrammatic representation of the power socket connection of the pendant ionizer according to one embodiment of the present disclosure.
Figure 13:
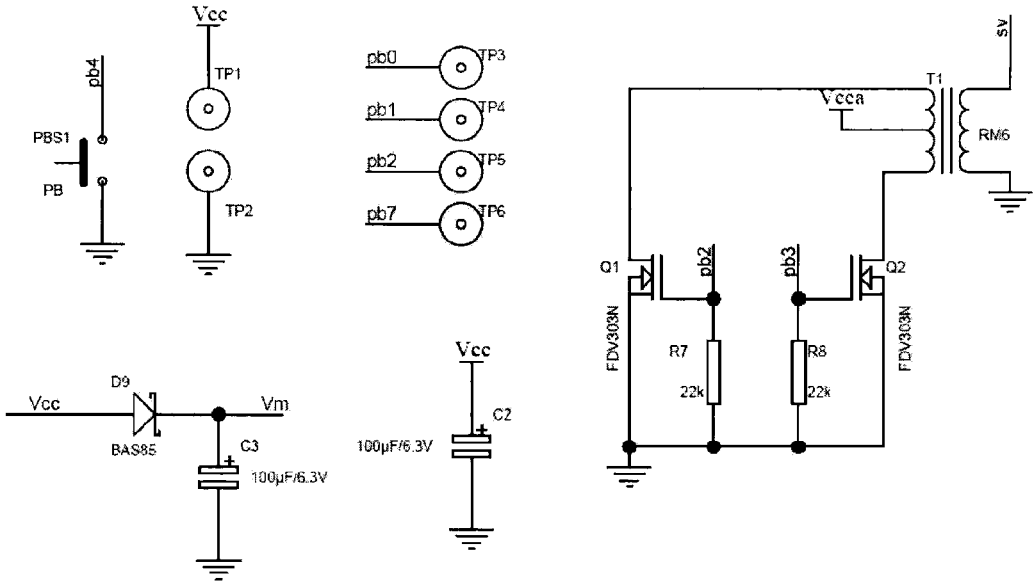
FIG. 13 is a diagrammatic representation of a balanced AC converter of the pendant ionizer according to one embodiment of the present disclosure.

Finally, FIG. 7A is a bottom view of the pendant ioniser 100 where an advertising space 99 is located on the junction between the case cover 4 and the back portion of the cover 13. While FIG. 7A illustrates one configuration where another advertising space 99 can be used, what is contemplated is the use of any surface of the pendant ioniser 100 as an advertising space.

Returning to FIG. 1, negative ions are produced when air is placed in the contact with the tip 60 of a needle 8 located on the upper portion of the pendant ionizer 100 at an opening 51. The tip 60 is the point with the greatest radii of curvature r and a density of charge d will become $q=4\pi r^2 d$, the potential $p=4\pi rd$ and the outward force f, normal to the surface becomes $f=2\pi d^2$. When d reaches a certain level the force f becomes sufficient to break down the dielectric of the surrounding molecules and a streamer or corona appears. It has also been found that the production of small desirable ions decreases at natural or proper frequencies of over 50 kHz as carrier frequencies.

In U.S. Pat. No. 5,973,905 hereby incorporated fully by reference, Applicant teaches how preferred selectable modulation frequencies for a negative air ion generator with a needle point are typically about 40 Hz, 25 Hz, 10 Hz, or about 7.83 Hz. The carrier frequency is typically a frequency in the range of 15 kHz to 20 kHz with about 17 kHz being optimal. Frequencies range from 1 Hz to any desired frequency. U.S. Pat. No. 5,973,905 also teaches how the corona requires the proximity of ground electrodes. In the case of the pendant ionizer 100, triangular ground electrodes 3, 14 as the surrounds reinforce the local electrical field created in the corona to separate negatively charged ions and positively charged ions to prevent their recombination and accelerate them. In the case of the embodiment as shown, the triangular ground electrodes 3, 14 are located on the top of the external case 101 and accelerate the ions up to an energy of 1.9 $cm^2/Vs$.

Figure 14:
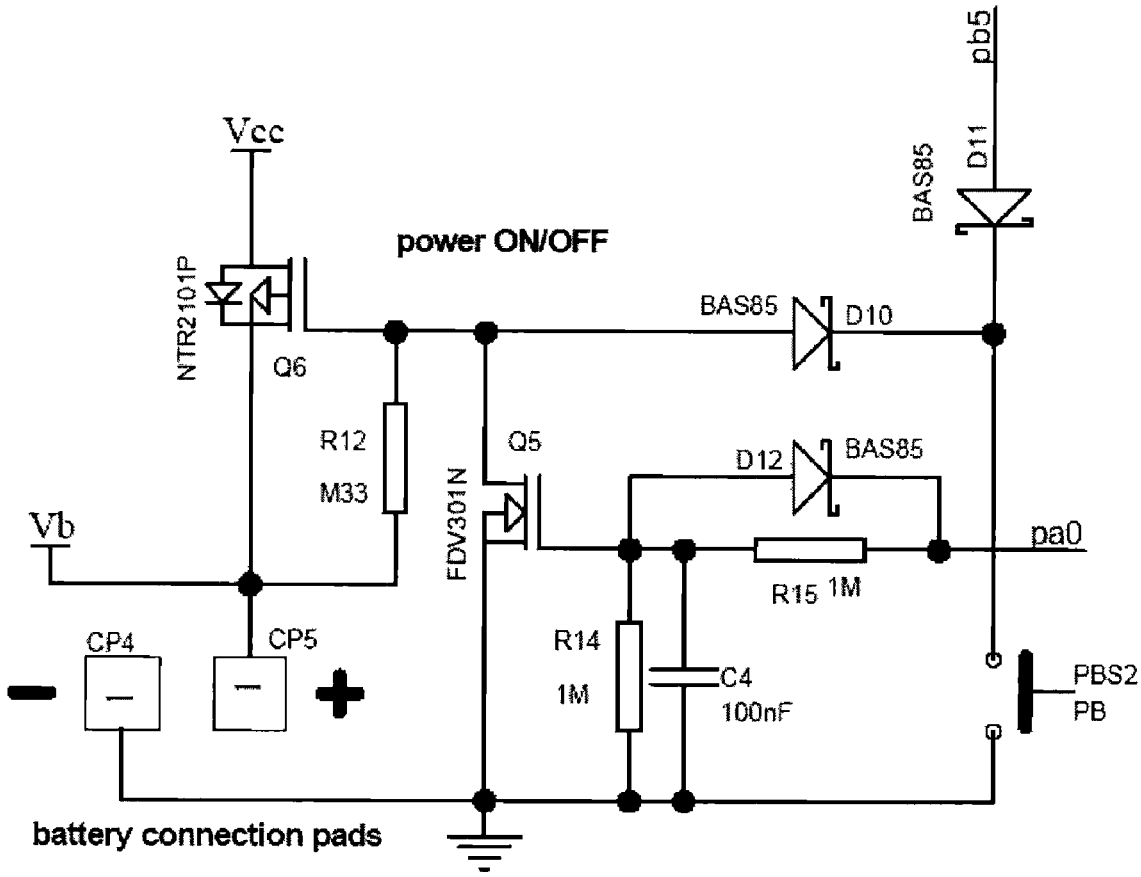
FIG. 14 is a diagrammatic representation of the battery recharge mechanism of the pendant ionizer according to one embodiment of the present disclosure.

In one embodiment, the portable air ionizer 100 is made of at least a needle discharge electrode 8 electrically connected to an integrated circuit 5 to produce an outward flux of negative ions when energized. A portable DC power source, shown as a cylindrical lithium-ion battery 6 with a maximum recharge voltage of about 4.2 volts and a discharge limit of about 3.1 volts, includes an anode and a cathode electrically connected via battery connection pads as shown in FIG. 14 as CP4 and CP5 to energize the needle discharge electrode 8.

In the embodiment shown in FIG. 1, the portable case 101 includes a support means for holding the power source such as a neck strap 12, an integrated circuit 5 with the different elements as shown in FIGS. 8-14, and the needle discharge electrode 8. The portable case 101 includes two ground electrodes 3, 14 electrically connected to the cathode CP4 to produce an electric field between the needle discharge electrode 8 and each ground electrode 3, 14. The ionizer 100 also includes a power management system as part of the integrated circuit 5 to minimize the drain of energy from the portable DC power source 6 as the needle discharge electrode 8 is energized and produces ions in the electric field.

FIG. 2 shows one possible control panel 54 where seven LEDs are aligned in two rows on the back portion 13 of the case 101. A MODE button 17 and a SET button 18 are used to input and control the different variable parameters of the portable ionizer 100. To activate the device, the SET button is pressed for a fixed period of time. In one embodiment, the duration to activate the device is 2 seconds. Once open, the device starts in the low-power mode and the low-frequency setting, which is the minimal operating power. The ionizer 100 has four power output levels: an off level representing 0% of the maximum level, a low level 21 representing 25% of the maximum voltage output, a medium level 20 representing 50% of the maximum voltage output, and a high level representing 100% of the maximum voltage output. The power level is toggled between the four respective levels by pressing the MODE button 17 until the power LED 25 located above the power symbol is illuminated. The toggle is then performed by pressing the SET button 18 until either all four LEDs 19, 20, 21, 25 are off to indicate a level at 0% or one of the three LEDs 19, 20, 21 is illuminated indicating the power level selected.

Changes in frequency of operation are performed in a similar way. The MODE button 17 is pressed until the frequency LED 23 is illuminated. By pressing the SET button 18, the frequency levels are toggled between the low level 21 at 4 Hz, the medium level 20 at 10 Hz, and the high level 19 at 25 Hz. Once the frequency is selected (i.e., the corresponding LED is lit), the control panel 54 returns to the power level as described above after 4 seconds of operation. LED 22 blinks once a limit of operation is reached. In one embodiment, the needle 8 can operate for 1100 hours before LED 22 begins to blink. To reset this function, in one contemplated embodiment, the ionizer 100 must be turned off and reset electronically after a new needle 60 is placed into the needle protector 7. The needle holder 61 is permanently fixed inside the unit. One method to reset the needle 60 is to press the MODE and SET buttons 17, 18 concurrently for a duration of 2 seconds. Finally, LED 24 corresponds to a battery level, which lights in association with one of the three LED levels 19-21. A replacement of the battery 6 may require the separation of the front and back portions 4, 13 once the battery 6 is at the end of life or has failed for example once it has reached 1000 charges and a selective disposal of the battery 6 that is environmentally friendly.

A battery recharge outlet 26 as shown in FIG. 2 is located in opening 52 and allows for the connection of a DC charger connected in turn to a local power network. In one embodiment, the charger is a 6 volt DC charger. In one contemplated embodiment, when the charger (not shown) is connected, the three LEDs 19, 20, 21 are lit sequentially to indicate the charge until the charger is removed from the outlet 26 or disconnected from the local network. In one contemplated embodiment, the pendant ionizer 100 can produce negative ions when the charger is connected to the outlet 26 to bypass the battery or the ionizer 100 may be off. In one contemplated embodiment, the lithium-ion battery is charged until the maximum recharge of the batteries of about 4.2 volts is reached. If the voltage of the lithium-ion battery reaches a low voltage of 3.1 volt, the circuit 5 switches off the ionizer 100 until the battery can be recharged. In one contemplated embodiment, the battery 6 can produce negative ions for a period of 16 hours (at high setting) up to 44 hours (at low setting). Once the battery can no longer be recharged, or for any other reason, the replacement of the battery requires the separation of the opposite halves 4, 13 of the portable case 101 and the physical removal of the battery 6 from the integrated circuit 5.

In a power save mode, each portion of the power management system is used at minimal power. These improvements of the power management system includes turning the LEDs off after a selection is made using the MODE 17 or SET 18 buttons, except for the power level LED 24, which blinks at the low duty position 21. In another embodiment shown in FIG. 14, the power management system further includes a symmetrical bi-phase circuit with Mosfets. In yet another embodiment, the step-up converter shown in FIG. 8 uses a pot core ferrite transformer operating at high frequency and driving into very high efficiency diodes and low capacitances.

A control module including a power management system, a transformer, and a multiplier is used to optimize power drain on a rechargeable battery. Other features of the power management system include LED display shut-off, battery voltage cut-off, management of needle life use, and management of power supply drain time through frequency modulation and/or voltage control. In yet another embodiment, the power management system includes a stand-by mode that is enabled when the needle discharge electrode 8 is not energized. In yet another embodiment, the power manager system further includes a balanced AC inverter connected to a multiplexer.

While one type of control mechanism is shown, the use of any type of interface or control that allows for easy and quick change of the power level, the frequency, and the other parameters as shown or any other parameter including the use of sound devices, rollers, click-in buttons, or any other type of button is contemplated.

In another embodiment, a method of advertisement of a service is contemplated where improved wellness is desired by a user using a portable air ionizer, the method including the steps of placing an advertisement of a service provider with users in need of an increased wellness on an exterior portion of a plurality of cases of air ionizers, distributing to users of the service a portable air ionizer, and displaying and using the portable air ionizer in association with a service of the service provider for association of the increased wellness with the service provider. In another embodiment, the above method can be used where the service provider is a commercial airline transportation provider (not shown) and wellness is obtained by using a needle to produce negative ions as shown in FIG. 1.

It is understood that the preceding is merely a detailed description of some examples and embodiments of the present invention and that numerous changes to the disclosed embodiments can be made in accordance with the disclosure made herein without departing from the spirit or scope of the invention. The preceding description, therefore, is not meant to limit the scope of the invention but to provide sufficient disclosure to one of ordinary skill in the art to practice the invention without undue burden.

What is claimed is:

1. A portable air ionizer, comprising:

a needle discharge electrode electrically connected to an integrated circuit to produce ions when energized;

a portable DC power source with an anode and a cathode electrically connected to the integrated circuit to energize the needle discharge electrode;

a portable case with a support means for holding the power source, the integrated circuit, and the needle discharge electrode, wherein the portable case includes two ground electrodes electrically connected to the cathode on each side of the needle to produce an electric field between the needle discharge electrode and each ground electrode;

a power management system as part of the integrated circuit to minimize the drain of energy from the portable DC power source as the needle discharge electrode is energized and produces ions in the electric field.

2. The portable air ionizer of claim 1, wherein the power management system includes a stand-by mode when the needle discharge electrode is not energized.

3. The portable air ionizer of claim 2, wherein the power management system further includes a balanced AC inverter connected to a multiplier.

4. The portable air ionizer of claim 2, wherein the power management system further includes a symmetrical bi-phase circuit with Mosfets.

5. The portable air ionizer of claim 1, wherein the portable DC power source is a rechargeable battery, and the ionizer further comprises an external power supply connector for charging the rechargeable battery on an external circuit.

6. The portable air ionizer of claim 1, further comprising a first advertising space on the external surface of the portable case.

7. The portable air ionizer of claim 6, further comprising a second advertising space on the external surface of the portable case in opposition to the first advertising space.

8. The portable air ionizer of claim 1, wherein the electrical field created by the needle discharge electrode and the two ground electrodes accelerates the ions to an energy level of 1.9 cm2/Vs.

9. The portable air ionizer of claim 5, wherein the portable DC power source is a lithium-ion battery with a maximum recharge voltage of about 4.2 volts and a discharge limit of about 3.1 volts.

10. The portable air ionizer of claim 1, wherein the replacement of the battery requires separation of opposite halves of the portable case, removal of the battery from the integrated circuit, and environmentally friendly disposal of the battery.

11. An interface for a portable air ionizer, comprising:

a control circuit in an integrated circuit; and a first button operable from the interface and connected to the control circuit, the button being capable of toggling between two alternate modes of operation, the first mode for setting a frequency of an AC current produced by the integrated circuit from a portable DC power source at a needle discharge electrode located between two ground electrodes on a portable case on each side of the needle discharge electrode to produce an electric field between the needle discharge electrode and each ground electrode, using a second button connected to the control circuit, and the second mode for setting a power level of AC current produced by the integrated circuit from the portable DC power source at the needle discharge electrode using the second button.

12. The interface for a portable air ionizer of claim 11, wherein the frequency of the AC is toggled using the second button between the values 4 Hz, 10 Hz, and 25 Hz.

13. The interface for a portable air ionizer of claim 11, wherein the power level of AC current is toggled using the second button between the values 0%, 25%, 50%, and 100% of nominal power.

14. The interface for a portable air ionizer of claim 11, wherein either the frequency or the power level is displayed on the interface using LEDs.

15. The interface for a portable air ionizer of claim 11, further comprising at least one indicator connected to the control circuit selected from the group consisting of an operation mode indicator, an operation selection indicator, a power save feature indicator, a needle change reminder indicator, a power level indicator, a battery charge indicator, a charge maintenance indicator, and an output wave shape control.

16. A method of managing energy consumption of a portable air ionizer equipped with the interface for a portable air ionizer as described in claim 14, the method comprising the step of programming the control circuit to turn off all of the LEDs after a fixed period of time after the second button has been pressed and released.

17. A method of managing energy consumption of a portable air ionizer equipped with the interface for a portable air ionizer as described in claim 14, the method comprising the step of blinking at a low duty cycle using the LED displaying the power level selected.

18. A method of advertising a service where improved wellness is desired by a user using a portable air ionizer, the method comprising the steps of:

placing an advertisement of a service provider with users in need of an increased wellness on an exterior portion of a plurality of cases of air ionizers;

distributing to users of the service a portable air ionizer with a needle discharge electrode, an anode and a cathode to energize the needle discharge electrode, and a portable case including two ground electrodes electrically connected to the cathode on each side of the needle to produce an electric field between the needle discharge electrode and each ground electrode;

a power management system as part of the integrated circuit to minimize the drain of energy from the portable DC power source as the needle discharge electrode is energized and produces ions in the electric field; and displaying and using the portable air ionizer in association with a service of the service provider for association of the increased wellness with the service provider.

19. The method of claim 18, wherein the service provider is a commercial airline transportation provider.

20. The method of advertisement of a service of claim 18, wherein the wellness is obtained by using a needle for producing a majority of negative ions.

* * * * *